US008572879B2

(12) United States Patent
Tiangco

(10) Patent No.: US 8,572,879 B2
(45) Date of Patent: Nov. 5, 2013

(54) FIREARM HAMMER WITH PIVOTING COCKING SPUR

(75) Inventor: David Angeles Tiangco, Virginia Beach, VA (US)

(73) Assignee: David Angeles Tiangco, Virginia Beach, VA (US)

( * ) Notice: Subject to any disclaimer, the term of this patent is extended or adjusted under 35 U.S.C. 154(b) by 200 days.

(21) Appl. No.: 13/342,143

(22) Filed: Jan. 2, 2012

(65) Prior Publication Data

US 2013/0167422 A1 Jul. 4, 2013

(51) Int. Cl.
*F41A 19/14* (2006.01)

(52) U.S. Cl.
USPC ..... 42/69.01; 42/69.03; 42/70.08

(58) Field of Classification Search
USPC ..... 42/69.01–69.03, 70.08
See application file for complete search history.

(56) References Cited

U.S. PATENT DOCUMENTS

| | | | | | |
|---|---|---|---|---|---|
| 2,941,325 | A * | 6/1960 | Ayala | 42/57 |
| 4,122,622 | A * | 10/1978 | Angelino | 42/65 |
| 4,151,782 | A * | 5/1979 | Allen | 89/155 |
| 4,412,397 | A * | 11/1983 | Bayn | 42/70.11 |
| 5,261,177 | A * | 11/1993 | Armstrong | 42/70.08 |
| 6,070,353 | A * | 6/2000 | Albrecht et al. | 42/69.01 |
| 7,140,138 | B1 * | 11/2006 | Laney et al. | 42/69.03 |

* cited by examiner

*Primary Examiner* — Michael David

(57) ABSTRACT

A firearm hammer that has its cocking spur attached in a hinged manner that is constantly biased to the closed position. Upon sufficiently applied force, the cocking spur can pivot about the hinge from the closed position to a plurality of open positions, and then due to the constant bias, the cocking spur automatically and rapidly returns to the closed position. In one embodiment, a spring at the hinge causes the constant bias of the cocking spur to the closed position. In the closed position, the cocking spur rests upon the main body of the hammer and is thereby supported to allow the hammer to be cocked. This invention reduces the probability of snagging the hammer on clothing as the firearm is drawn for use. This invention also allows instinctive use of the cocking spur since it is automatically and rapidly returned to the closed position after deviations thereof.

7 Claims, 3 Drawing Sheets

FIREARM HAMMER WITH PIVOTING COCKING SPUR

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of Invention

This invention relates to firearms, preferably small firearms such as handguns (e.g. revolvers and pistols). Specifically, this invention is a new and improved firearm hammer with its cocking spur attached in a hinged manner that is constantly biased to the closed position. The pivoting nature of the cocking spur attached in this manner reduces the probability of snagging the hammer on clothing or other materials as the firearm is drawn for use. The constant bias to the closed position allows instinctive use of the cocking spur once a potential snag is cleared since it automatically and rapidly returns the cocking spur to the closed position without any extraneous manipulation. This invention may be installed into firearms as an improvement over previous art hammers.

The firearm hammer is that component which impacts the firing pin or striker in order to ignite the primer within a chambered ammunition cartridge. The cocking spur is that portion of the firearm hammer which projects prominently from the superior aspect, thereby providing a highly convenient and sufficient platform for the user to index and apply force in order to cock the hammer. However, due to its shape, the cocking spur may also interfere with drawing the firearm from a place of storage (e.g. clothing) since it may inadvertently become snagged in a barb-like manner.

Snagging of the cocking spur increases the time and effort necessary to fully draw the firearm for use, which may compromise the safety and performance efficiency of the user during a self-defense or competitive situation. It would therefore benefit the field of art to introduce a new and improved hammer which reduces the probability of snagging during the draw of the firearm, yet simultaneously retains the advantages of having a prominent cocking spur available for instinctive use. This invention provides such a benefit.

2. Related Art

Prior art hammers which embody snag-resistant features are known to the field of art. For example, U.S. Pat. No. 4,122,622 issued to Angelino on Jan. 5, 1977, which addresses the problem of snagging by incorporating a hammer spur that can be fully recessed into the main body of the hammer and manually pivoted out for use. The present invention is significantly different in that the cocking spur of the hammer is never fully recessed into the main body of the hammer where it would be unavailable for indexing and cocking by the user. Instead, in the closed position, the cocking spur of the hammer projects sufficiently and is properly supported for immediate indexing and cocking by the user. Also, since the closed position is rapidly achieved by an automatic return mechanism, the cocking spur is made ready for use without extraneous manipulation required by the user. When the cocking spur of the current invention transiently yields the closed position to adopt an open position due to impingement upon clothing or other material, the snag resistant properties become quite evident.

BRIEF SUMMARY OF THE INVENTION

The objective of this invention is to provide a new and improved firearm hammer that may be assembled onto a firearm and reduce the probability of snagging upon clothing or other materials as the firearm is drawn for use. This invention comprises a firearm hammer with its cocking spur attached in a hinged manner that is constantly biased to the closed position. The hinge enables the cocking spur to adopt a plurality of open positions upon sufficiently applied force, thereby allowing it to clear potential snags, such as those that may be caused by impingement upon obstructions during the draw. The constant bias to the closed position automatically and rapidly returns the cocking spur to the closed position after potential snags are cleared. In one preferred embodiment, the constant bias to the closed position is created by a properly tensioned coil spring situated at the hinge. In other embodiments, a magnetic material situated at the interface between the cocking spur and the main body of the hammer performs the same function. In other embodiments, the cocking spur itself, or the main body of the hammer itself, is sufficiently magnetized to perform the same function.

DETAILED DESCRIPTION OF THE INVENTION

Figure 1:
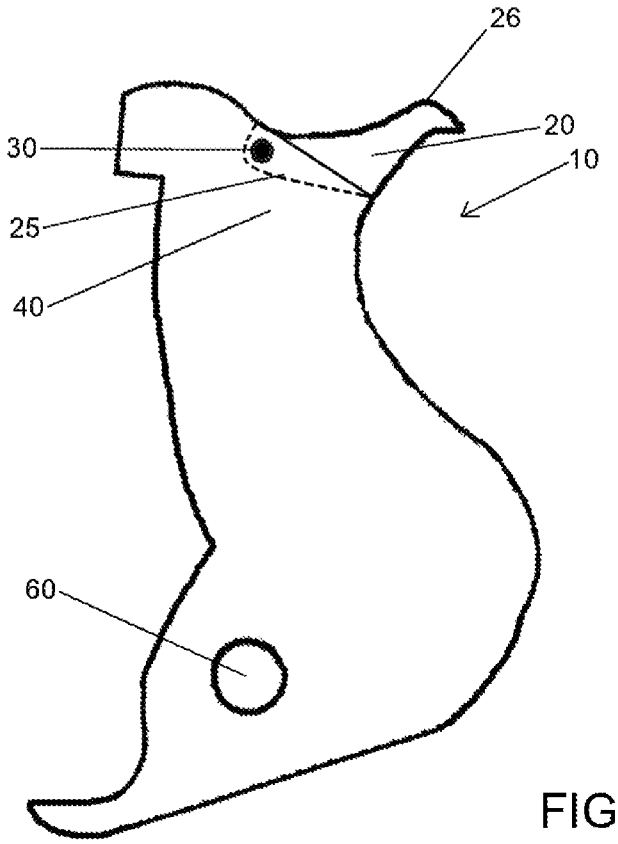
FIG. 1 is a lateral view of the hammer with its cocking spur attached in a hinged manner and in the closed position.
Figure 2:
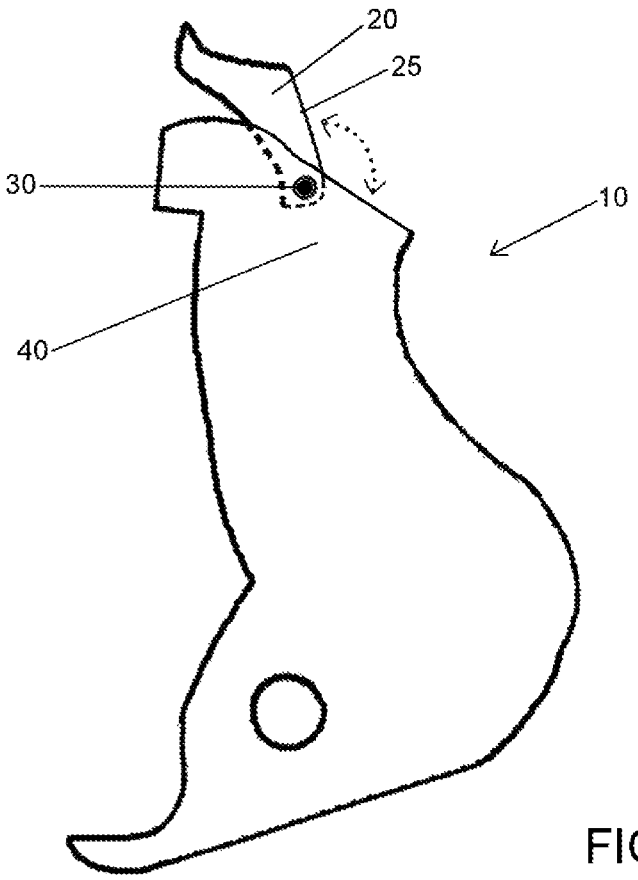
FIG. 2 is a lateral view of the hammer with its cocking spur attached in a hinged manner and in an open position.
Figure 3:
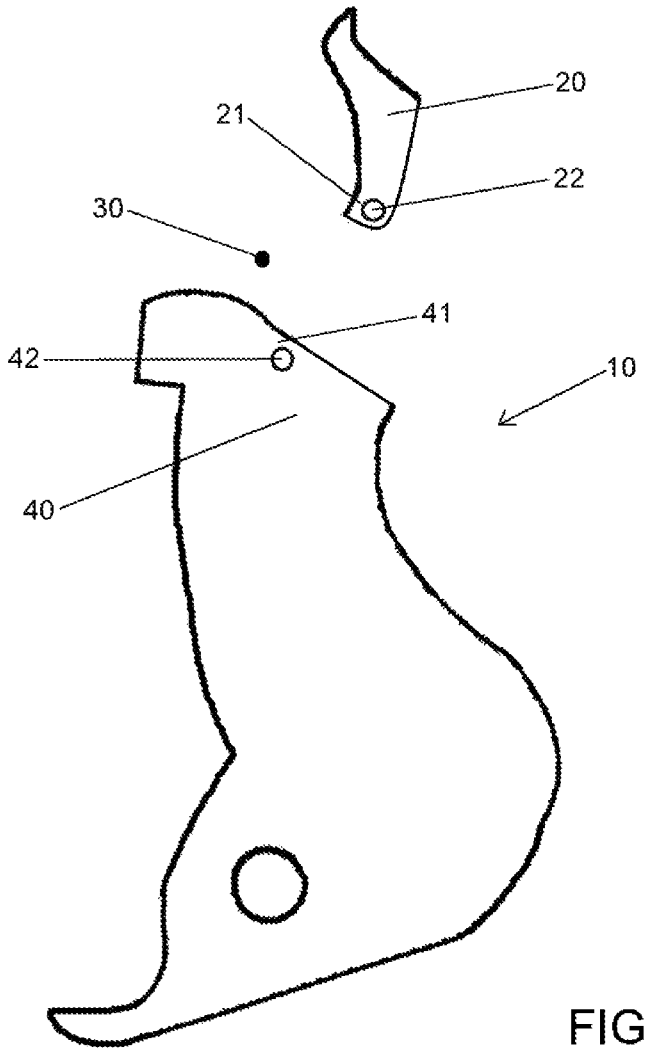
FIG. 3 is a lateral view of the disarticulated components of the hammer.

The new and improved hammer is shown in FIGS. 1-3 as reference numeral 10. Although specific drawings of the hammer have been rendered and various embodiments disclosed, it is understood that in order to accommodate fabrication methods and fitting the invention onto the various firearms that exist, various modifications in design may occur to those knowledgeable in the art while still retaining the essence of the invention. Therefore, precise shapes, dimensions, and tolerances need not be specified, nor are they limited by the scope of the invention.

In FIG. 1, hammer 10 is shown in lateral view with its cocking spur 20 attached in a hinged manner by way of cocking spur pin 30 and in the closed position. The dashes outline that portion of cocking spur 20 hidden from view as it lies in a groove within the main body 40 of the hammer. Said groove is shaped to accommodate said portion of cocking spur 20 and allows pivoting about the hinge, yet does not fully enclose cocking spur 20, thereby allowing full access to indexing surface 26 by the user. While in the closed position, inferior surface 25 of cocking spur 20 directly contacts and rests upon the main body 40 of the hammer.

In FIG. 2, hammer 10 is shown in lateral view with its cocking spur 20 attached in a hinged manner by way of cocking spur pin 30 and in an open position. The dashes outline that portion of cocking spur 20 hidden from view as it lies in a groove within the main body 40 of the hammer. To achieve an open position, cocking spur 20 is pivoted about the hinge in the counterclockwise direction as viewed from FIG. 2, such that inferior surface 25 of cocking spur 20 moves away from the main body 40 of the hammer in the path depicted by the arrow-ended dotted arc. To return to the closed position, cocking spur 20 is pivoted about the hinge in the clockwise direction as viewed from FIG. 2, such that inferior surface 25 of cocking spur 20 moves towards the main body 40 of the hammer in the path depicted by the arrow-ended dotted arc.

In FIG. 3, hammer 10 is shown in lateral view and disarticulated into its component parts. As seen in FIG. 3, the hinge consists of: (a) an integral portion 21 of cocking spur 20 shaped with openings 22 to accept cocking spur pin 30, (b) cocking spur pin 30, and (c) an integral portion 41 of the main body 40 of the hammer shaped with openings 42 to accept cocking spur pin 30. Upon full assembly of the hammer, openings 22 and 42 align precisely to allow cocking spur pin 30 to be fully inserted, whereby the integral portion 21 of cocking spur 20 mates cooperatively in juxtaposition to the integral portion 41 of the main body 40 of the hammer. Both said portions are held in place by cocking spur pin 30 which also acts as the pivot point of the hinge. Upon full assembly of the hammer, both ends of cocking spur pin 30 are flush with the outer surfaces of the integral portion 41 of the main body 40 of the hammer.

In operation, cocking spur 20 of hammer 10 may take on either the closed position or a plurality of open positions. In the closed position, the inferior surface 25 of cocking spur 20 rests upon the main body 40 of the hammer and is thereby immobilized from further pivoting about the hinge in the clockwise direction as viewed from FIG. 1. Any sufficiently applied force on indexing surface 26 of cocking spur 20 while it is in the closed position will instead cause hammer 10 to pivot about a hammer pin, normally inserted through opening 60, to become cocked.

Upon opening, cocking spur 20 pivots at the hinge in the counterclockwise direction as viewed from FIG. 2 and may adopt a plurality of positions within the semi-circular path depicted by the arrow-ended dotted arc. Said path is aligned within the same plane that hammer 10 moves to become cocked. It is understood that the length of said path is sufficient to allow cocking spur 20 to clear obstructions impinging upon it as the firearm is drawn for use, but not sufficient to obstruct the normal cycling action of the hammer.

In one preferred embodiment, constant biasing to the closed position is achieved by way of a coil spring placed in position at the hinge and surrounding the shaft of cocking spur pin 30. Said spring is tensioned against cocking spur 20, biasing it in the clockwise direction, as viewed from FIG. 2, thereby forcing inferior surface 25 of cocking spur 20 against the main body 40 of the hammer (i.e. the closed position). Upon counterclockwise movement of cocking spur 20, as viewed from FIG. 2, the counteractive tension of said spring maintains the bias of cocking spur 20 towards the closed position. It is understood that the tension of said spring is sufficient to return cocking spur 20 to the closed position from an open position, but is not sufficient to significantly impede rotation about the hinge in the counterclockwise direction, as viewed from FIG. 2, as may be brought about by drawing the firearm from storage and impingement of cocking spur 20 upon an article of clothing or other material.

In other embodiments, constant biasing to the closed position is achieved by way of a sufficiently polarized magnetic material affixed to the main body 40 of the hammer, or the inferior surface 25 of cocking spur 20. Said material magnetically attracts cocking spur 20 to main body 40 of the hammer, biasing it in the clockwise direction, as viewed from FIG. 2, thereby forcing inferior surface 25 of cocking spur 20 against the main body 40 of the hammer (i.e. the closed position). Upon counterclockwise movement of cocking spur 20, as viewed from FIG. 2, the magnetic attraction of said material maintains the bias of cocking spur 20 towards the closed position. It is understood that the magnetic attraction of said material is sufficient to return cocking spur 20 to the closed position from an open position, but is not sufficient to significantly impede rotation about the hinge in the counterclockwise direction, as viewed from FIG. 2, as may be brought about by drawing the firearm from storage and impingement of cocking spur 20 upon an article of clothing or other material.

In other embodiments, constant biasing to the closed position is achieved by way of a sufficiently magnetized cocking spur 20, or a sufficiently magnetized main body 40 of the hammer. Said magnetized cocking spur 20, or magnetized main body 40 of the hammer, magnetically attracts cocking spur 20 to main body 40 of the hammer, biasing it in the clockwise direction, as viewed from FIG. 2, thereby forcing inferior surface 25 of cocking spur 20 against the main body 40 of the hammer (i.e. the closed position). Upon counterclockwise movement of cocking spur 20, as viewed from FIG. 2, the magnetic attraction of said magnetized cocking spur 20, or magnetized main body 40 of the hammer, maintains the bias of cocking spur 20 towards the closed position. It is understood that the magnetic attraction of said magnetized cocking spur 20, or magnetized main body 40 of the hammer, is sufficient to return cocking spur 20 to the closed position from an open position, but is not sufficient to significantly impede rotation about the hinge in the counterclockwise direction, as viewed from FIG. 2, as may be brought about by drawing the firearm from storage and impingement of cocking spur 20 upon an article of clothing or other material.

What is claimed is:

1. A new and improved firearm hammer comprising: a hammer with its cocking spur attached in a hinged manner that is constantly biased to the closed position, wherein the cocking spur, in the closed position, rests upon the main body of the hammer and is thereby properly supported and protrudes sufficiently for indexing and cocking, wherein the cocking spur can pivot about the hinge from the closed position to a plurality of open positions, and wherein the constant bias causes the automatic and rapid return of the cocking spur back to the closed position after deviations thereof.

2. The hammer of claim 1 wherein said hinge is comprised of: (a) an integral portion of the cocking spur shaped with openings to accept a cocking spur pin, (b) a cocking spur pin, and (c) an integral portion of the remainder of the hammer shaped with openings to accept the cocking spur pin.

3. The hammer of claim 1 wherein said bias is caused by a coil spring situated at the hinge and tensioned to pivot the cocking spur automatically and rapidly into the closed position from an open position.

4. The hammer of claim 1 wherein said bias is caused by material affixed to the inferior surface of the cocking spur that is sufficiently magnetized to pivot the cocking spur into the closed position from an open position.

5. The hammer of claim 1 wherein said bias is caused by material affixed to the main body of the hammer that is sufficiently magnetized to pivot the cocking spur into the closed position from an open position.

6. The hammer of claim 1 wherein said bias is caused by a hammer spur that is itself sufficiently magnetized to pivot the cocking spur into the closed position from an open position.

7. The hammer of claim 1 wherein said bias is caused by the main body of the hammer that is itself sufficiently magnetized to pivot the cocking spur into the closed position from an open position.

* * * * *